US011591803B2

(12) United States Patent
Gervasoni

(10) Patent No.: US 11,591,803 B2
(45) Date of Patent: Feb. 28, 2023

(54) PANEL FASTENING SYSTEM

(71) Applicant: Swisspearl Group AG, Niederurnen (CH)

(72) Inventor: Aristide Gervasoni, Walenstadt (CH)

(73) Assignee: Swisspearl Group AG, Niederurnen (CH)

( * ) Notice: Subject to any disclaimer, the term of this patent is extended or adjusted under 35 U.S.C. 154(b) by 0 days.

(21) Appl. No.: 17/596,609

(22) PCT Filed: Jan. 5, 2021

(86) PCT No.: PCT/EP2021/050068
§ 371 (c)(1),
(2) Date: Dec. 14, 2021

(87) PCT Pub. No.: WO2021/223916
PCT Pub. Date: Nov. 11, 2021

(65) Prior Publication Data

US 2022/0275652 A1 Sep. 1, 2022

(30) Foreign Application Priority Data

May 4, 2020 (EP) ..... 20172661

(51) Int. Cl.
*E04F 13/08* (2006.01)

(52) U.S. Cl.
CPC ..... *E04F 13/0835* (2013.01)

(58) Field of Classification Search
CPC ..... E04F 13/0835; E04F 13/0851
(Continued)

(56) References Cited

U.S. PATENT DOCUMENTS 1,760,265 A * 5/1930 Carr ..... B60R 13/0206 411/113
1,804,831 A * 5/1931 Hardesty ..... B60R 13/04 24/295

(Continued)

FOREIGN PATENT DOCUMENTS

FR 2 985 276 A1 7/2013
NL 1000265 C2 10/1995

(Continued)

OTHER PUBLICATIONS

International Search Report for PCT/EP2021/050068, dated Mar. 19, 2021.
Written Opinion for PCT/EP2021/050068, dated Mar. 19, 2021.

*Primary Examiner* — Beth A Stephan
(74) *Attorney, Agent, or Firm* — Sughrue Mion, PLLC

(57) ABSTRACT

A panel fastening system includes a panel having a visible side and a rear side, at least one slot which is introduced into the rear side of the panel and which extends along a longitudinal axis, and which has at least one stop face, wherein a first slot portion extends between the at least one stop face and the rear side, and wherein a second slot portion extends between the at least one stop face and the slot base, and at least one fastening element which is inserted into the slot and which has a fastening portion and a contact face, wherein the contact face of the fastening element abuts against the at least one stop face, wherein the panel fastening system further comprises at least one securing element which can be arranged in the slot to secure the fastening element.

61 Claims, 8 Drawing Sheets

(58) Field of Classification Search
USPC ..... 52/506.05
See application file for complete search history.

(56) References Cited

U.S. PATENT DOCUMENTS

| | | | | | |
|---|---|---|---|---|---|
| 1,931,899 | A * | 10/1933 | McLeod | F16B 43/003 | 411/533 |
| 4,856,245 | A * | 8/1989 | Osawa | E04F 13/185 | 52/510 |
| 4,890,433 | A * | 1/1990 | Funaki | E04F 13/0801 | 52/510 |
| 6,164,029 | A * | 12/2000 | Lee | E04F 13/0851 | 52/235 |
| 9,016,020 | B1 * | 4/2015 | Yang | E04F 13/0803 | 52/511 |
| 9,109,358 | B2 * | 8/2015 | Kloster | E04F 19/0463 | |
| 9,803,668 | B2 * | 10/2017 | Reeves | F16B 5/02 | |

FOREIGN PATENT DOCUMENTS

| | | | | |
|---|---|---|---|---|
| NL | 9400706 | A | 12/1995 | |
| WO | WO-8908788 | A * | 9/1989 | F16B 21/09 |

* cited by examiner

PANEL FASTENING SYSTEM

This application is a National Stage of International Application No. PCT/EP2021/050068 filed Jan. 5, 2021, claiming priority based on European Patent Application No. 20172661.9 filed May 4, 2020.

TECHNICAL FIELD

The present invention relates to a panel fastening system and to a method for providing a panel fastening system.

PRIOR ART

Many systems which can be used to connect a panel to further elements have been disclosed by the prior art. A panel is for example a facade panel which is to be connected to a substructure. There are, however, also mounting-related problems in other applications such as cladding for interior construction, panel connections with one another, etc.

In principle, it is desirable to mount the panel such that the fastening means are not visible from the visible side. Many solutions are known from the prior art. By way of example, NL 1000265 C2 discloses a slot in which a fastening means is introduced, wherein the slot is arranged on the rear side of a panel. A disadvantage of the technical teaching of NL 1000265 C2 is that the screw can move in the slot during mounting, which makes the mounting operation more difficult.

SUMMARY OF THE INVENTION

Proceeding from this prior art, the invention is based on an object of specifying a panel fastening system which overcomes the disadvantages of the prior art. In particular, a preferred object of the present invention is to specify a panel fastening system which can be mounted more easily.

This object is achieved by the panel fastening system as claimed. Accordingly, a panel fastening system comprises a panel, in particular a fiber cement board, having a visible side and a rear side, at least one slot which is introduced into the rear side of the panel and which extends along a longitudinal axis, and which has at least one stop face, wherein a first slot portion extends between the at least one stop face and the rear side, and wherein a second slot portion extends between the at least one stop face and the slot base, and at least one fastening element which is inserted into the slot and which has a fastening portion and a contact face, wherein the contact face of the fastening element abuts against the at least one stop face.

The panel fastening system further comprises at least one securing element which can be arranged in the slot, wherein the at least one securing element secures the at least one fastening element against a movement in the direction of the longitudinal axis. In other words, the securing element fixes the fastening element in the slot with respect to a movement in the direction of the longitudinal axis, in such a way that the fastening element is not displaced relative to the slot in the direction of the longitudinal axis.

The arrangement of the securing element affords the advantage that the fastening element in the slot is secured against movement in the slot. The panel of the panel fastening system can thus be fastened more easily.

The stop face in the slot forms a stop against a pulling-out force, which acts on the fastening element substantially at a right angle with respect to the rear side.

Furthermore, the panel can be mounted in all spatial positions independently of the orientation of the slot. In the case of a facade panel, the panel can be mounted in such a way that the slot extends in the horizontal direction, in the vertical direction or inclined at an angle with respect to the horizontal or vertical without the fastening element slipping in the slot. The latter would have the disadvantage that ultimately the panel could shift relative to the substructure.

A further advantage is also that the mounting of the panel with the fastening elements becomes easier because the fastening elements lie in a positionally fixed manner with respect to the panel due to the securing element.

There is a further advantage in the storage and transport of the panel fastening system. The at least one fastening element can be inserted into the slot. Furthermore, the at least one securing element can be arranged in the slot. This means that the panel, the at least one fastening element and the at least one securing element can be stored and transported separately from one another. This is an advantage in particular with respect to fastening elements which are fixedly introduced into panels, because the panels can be transported flatly on top of one another without spacers for protection of the fastening elements.

The fastening element abuts against the stop face in such a way that a tensile force acting on the fastening element can be introduced in the direction of a surface normal to the rear side and away from the rear side via the stop face into the panel.

The width of the first slot portion, as seen transverse to the longitudinal direction, is smaller than the width of the second slot portion. The width is viewed as being the distance transverse to the longitudinal axis between the side walls of the respective slot portions.

The fastening element lies substantially in the second slot portion. Depending on the design, the fastening element may extend through the first slot portion.

The expressions "horizontally" and "vertically" used herein are understood as directions running in the respective spatial direction in an installation position of the panel. In this case, the horizontal is at a right angle with respect to the direction of gravity and the vertical is parallel to the direction of gravity.

The panel fastening system can be used for various applications. Particularly preferably for facade panels or cladding for interior construction. However, the panel fastening system can also be used to connect two panels to one another.

The panel is preferably a fiber cement board. Fiber cement boards are typically composed of cement and tension-resistant fibers. Panels of this kind are typically produced by the Hatschek process. The panel can, however, also be made of another material. Examples mentioned here are wood, natural slate, natural rock (e.g. granite, gneiss, quartzite, porphyry, sandstone or marble), ceramic (e.g. fine stoneware, stoneware, Cotto), fiber-reinforced fine concrete (e.g. Cemfor, Rebeton), fiber-reinforced slate/stone chippings (e.g. Cottostone), fiber-reinforced laminates, metals (e.g. coated steel sheets, zinc copper titanium alloy, aluminum, copper, or chrome steel), layered composite materials (laminates, e.g. Alucobond), glass, or carrier plates which are rendered in a full-area manner.

In principle, homogeneous, organic and inorganic materials or combinations, such as fiber composite structures or layered composite structures, can be used.

The geometrical dimensions, such as thickness, format, or the appearance, such as colour, of the panel are independent of the fastening concept proposed herein. Equally, the visible side can be provided with aesthetic elements, such as colours or surface structures.

The number of slots and the distances between individual slots depends substantially on the size and shape of the panel and on the associated static requirement for connection to the substructure.

The slot is introduced into the panel in such a way that it is not visible from the visible side. This means that the depth of the slot is smaller than the thickness of the panel.

The visible side and the rear side run parallel to one another, and the distance between the visible side and the rear side defines the thickness of the panel.

The slot preferably has at least one end region, wherein the fastening element is arranged in the end region, and wherein the securing element extends away from the fastening element in the direction of the longitudinal axis.

The fastening element is preferably fixed or clamped in between the end region and the fastening element.

The end region of the slot is the region which, as seen in the direction of the longitudinal axis, is the end of the slot. In this case, the end region preferably has end faces, against which the fastening element abuts. In this case, the end faces are, depending on the design of the slot, at least partially transverse to the longitudinal axis.

The slot particularly preferably has two end regions. In a variant, a respective fastening element is arranged in each of the two end regions, wherein the securing element extends from one of the fastening elements to the other of the fastening elements. In this variant, the securing element retains the two fastening elements at a determined distance and fixes or clamps them against the end region.

In another variant, a fastening element is arranged only in one of the two end regions, wherein the securing element extends from the fastening element to the opposite end region. In this variant, the securing element extends substantially from the opposite end region up to the fastening element and thus prevents a movement of the fastening element in the slot.

Preferably, the slot has a further stop face and the securing element has a face, wherein when the securing element is inserted into the slot, the face comes into contact with the further stop face in such a way that the securing element is prevented from moving in the direction of the longitudinal axis.

The abutment of the face of the securing element against the stop face affords the advantage that the securing element is additionally secured with respect to a longitudinal movement in the slot.

The slot preferably has a mounting opening via which the at least one fastening element can be inserted into the slot, wherein the diameter of the mounting opening, as seen transverse to the longitudinal axis, corresponds substantially to the width of the second slot portion.

The mounting opening is preferably located centrally between the two end regions of the slot.

The further stop face mentioned above is preferably provided by the face of the mounting opening.

In a variant, the stop face of the slot preferably runs parallel to the rear side. In another variant, the stop face of the slot runs inclined at an angle with respect to the rear side.

The variant in which the slot runs parallel to the rear side has the advantage that no further material weakening occurs above the stop face, that is to say laterally with respect to the first slot portion.

The variant in which the slot runs inclined at an angle with respect to the rear side has the advantage that the tensile forces acting on the fastening element can be conducted into the panel in a more effective manner.

The stop face in the end regions, as seen from above on the visible side, preferably extends in each case in the shape of a part of a circle around the slot end. Viewed geometrically, the stop face can have the shape of a part of a ring face or the shape of a part of a cone envelope.

The stop face of the slot preferably extends on both sides with respect to the first slot portion.

The slot particularly preferably has the shape of a T-slot or the shape of a dovetail slot. Other shapes are also conceivable.

The securing element is preferably designed as at least one insert part. The insert part is inserted into the slot. The insert part can then be inserted after the at least one fastening element has been inserted into the slot.

The insert part is designed in this case as a separate element, that is to say that the insert part is separate from the fastening element and from the slot or from the panel.

The insert part is preferably made of plastic. The insert part preferably fills the slot completely in the region between two fastening elements or in the region between a fastening element and an end region.

The insert part preferably has, at least on one end side, a surface region which can be placed against the at least one fastening element.

The insert part preferably has two insert portions which are connected to one another by means of a film hinge, wherein the insert portions can be pivoted about the film hinge relative to one another, wherein the insert part can be inserted into the slot when the insert portions are in the folded-together state, and wherein, during the insertion operation, the insert portions can be brought into contact with the slot base in such a way that, upon further insertion of the insert part into the slot, the insert portions can be inserted into the region between the stop face and the slot base.

The expression "film hinge" is understood to mean a material zone which has only a small thickness, such that the two insert portions can be pivoted relative to one another.

The insert part preferably has, on the top side, a cylindrical portion which comes to lie in the mounting opening. The cylindrical portion has the aforementioned face which bears against the further stop face.

The securing element preferably furthermore has an opening which is arranged in such a way that the securing element can be removed. The opening is preferably arranged such that a hook-like tool can be guided through the opening, with the result that the securing element can be folded together by means of the film hinge. The opening preferably passes through the film hinge.

In an alternative embodiment to the insert part, the securing element is a viscous composition which can be introduced into the slot and which can be cured in the slot. In this case, the slot is substantially completely filled with the composition after the fastening element has been inserted, wherein the fastening means is no longer able to move after the composition has been cured.

The composition may be provided for example by the following materials:

curing adhesive, in particular in liquid or paste-like form,
solvent-containing adhesives,
dispersion and powder adhesives,
1-component polyurethane adhesives (1K-PUR),
2-component polyurethane adhesives (2K-PU),
epoxy resin adhesives,
hybrid adhesives, dry adhesives,
hotmelt adhesives,
cyanoacrylate adhesives,
anaerobic adhesives,
equalizing mortar,
resins, such as acrylic resins, polyurethane resins, epoxy resins, polyester resins, concrete casting resins, vinyl ester resins, silicone resins, phenoplasts, methacrylate resins.

In a variant, the fastening portion has a female thread, wherein the nominal diameter of the female thread is smaller than the width of the first slot portion. The female thread can come into engagement with the external thread of a screw. The fastening portion preferably has an external thread which extends out of the slot beyond the rear side.

Preferably, the slot has, from the rear side as far as the slot base, a depth which is selected in such a way that a residual wall thickness remains.

The thickness of the panel is defined as the distance between the visible side and the rear side. In the case of a fiber cement board, the thickness is preferably between 4 millimeters and 20 millimeters. In particular between 8 millimeters or 12 millimeters. In the case of fiber cement, the minimum residual wall thickness is preferably 2 millimeters.

A method for providing a panel fastening system according to the above description is characterized in that, in a first step, the at least one fastening element is inserted into the slot, and in that, in a second step subsequent to the first step, the securing element is arranged in the slot.

During the production of the panel, the slot is introduced on the rear side preferably by means of a milling operation.

Further embodiments are specified in the dependent claims.

BRIEF DESCRIPTION OF THE DRAWINGS

Preferred embodiments of the invention will be described below with reference to the drawings, which serve merely for explanation and are not to be interpreted as limiting. In the drawings.

DESCRIPTION OF PREFERRED EMBODIMENTS

Figure 1:
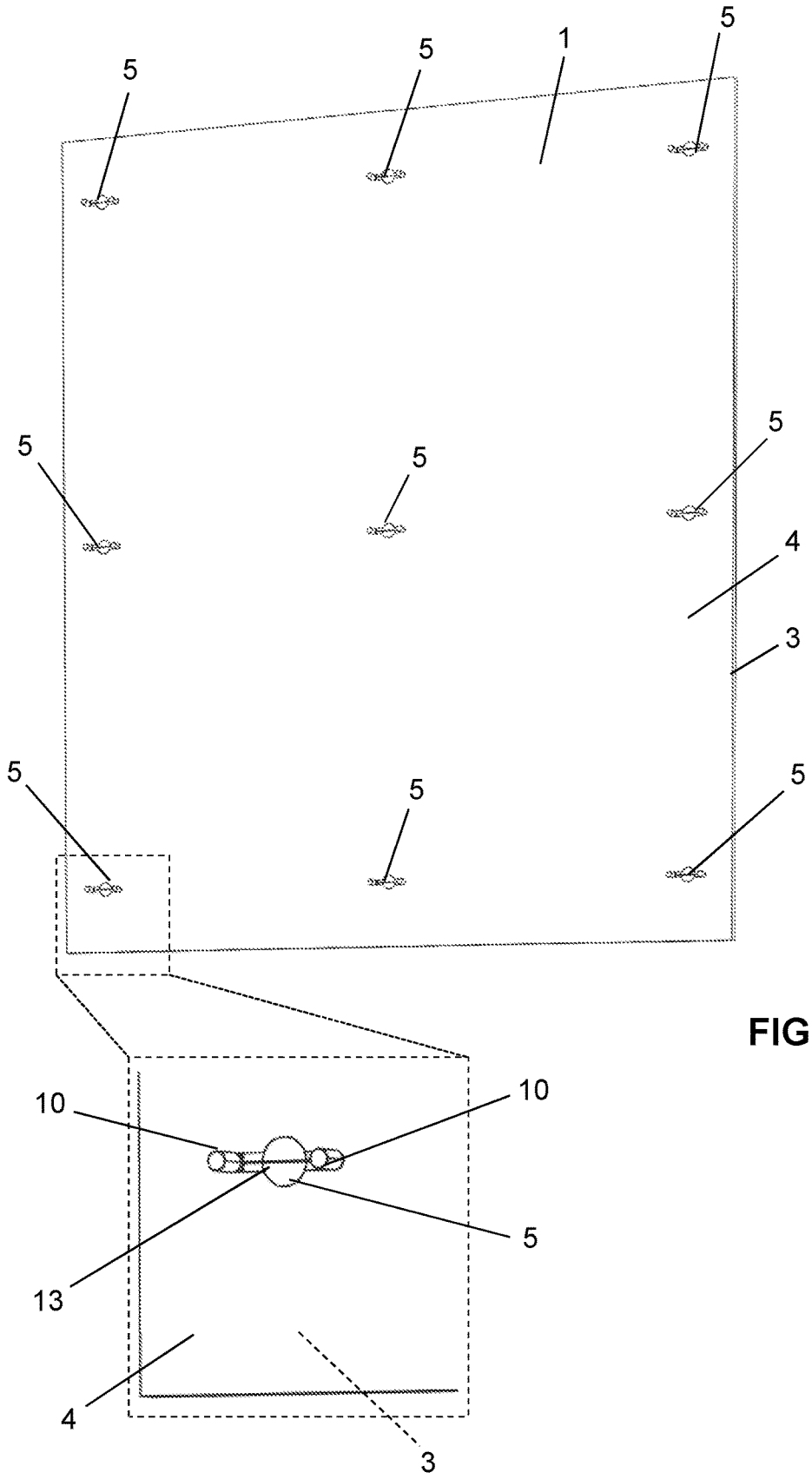
FIG. 1 shows a perspective view and a detail view of a panel fastening system comprising a panel, at least one slot, at least one fastening element and at least one securing element.
Figure 2:
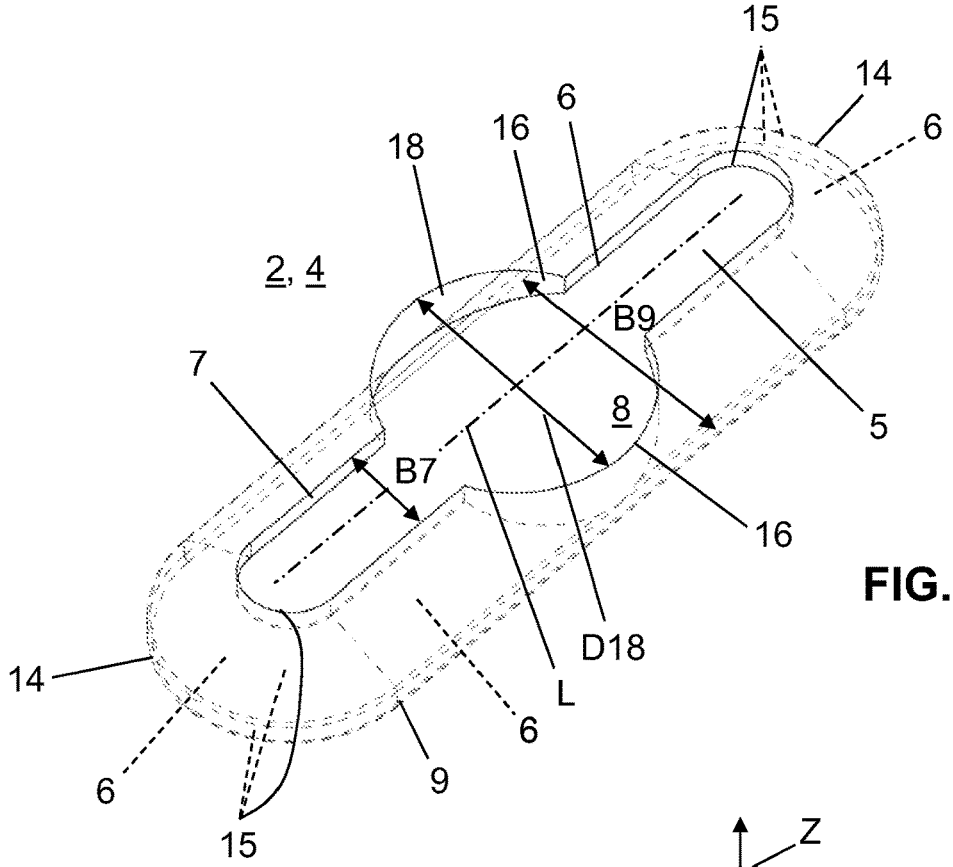
FIG. 2 shows a perspective view of the slot as per FIG. 1.
Figure 7:
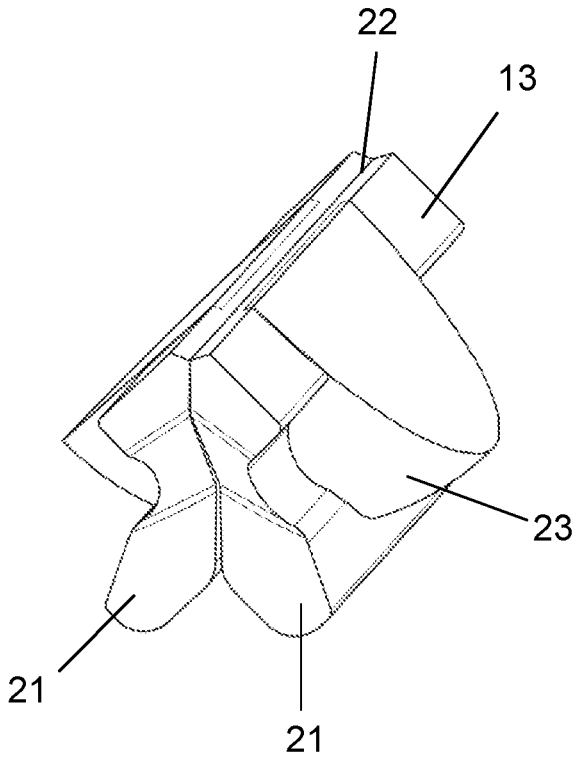
FIG. 7 shows a perspective view of the securing element as per the preceding figures in the folded-together state.
Figure 8:
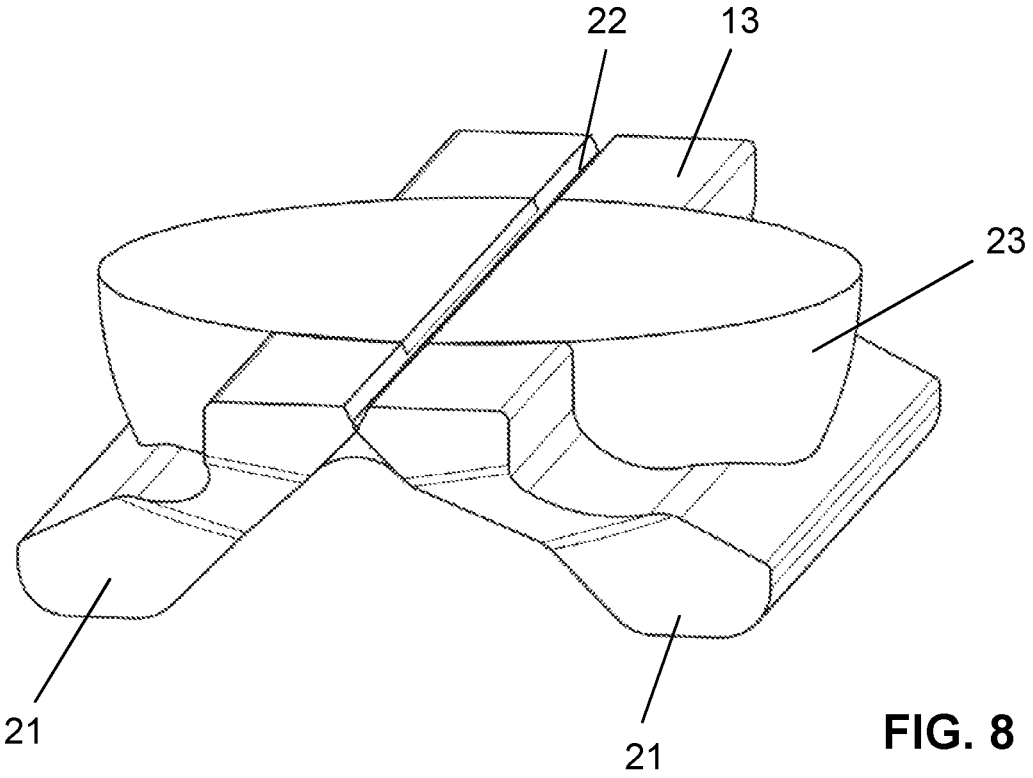
FIG. 8 shows a perspective view of the securing element as per the preceding figures in the inserted state.

The figures show a panel fastening system 1 according to a preferred embodiment of the present invention. The panel fastening system 1 is illustrated in overall form in FIG. 1 and in detail form in FIGS. 2 to 6. FIGS. 7 to 8 show a securing element 13 according to an embodiment for the panel fastening system 1. FIGS. 10 to 13 show the panel fastening system 1 with a securing element according to a further embodiment.

The panel fastening system 1 as shown in all the figures comprises a panel 2 having a visible side 3 and a rear side 4. The panel is preferably a fiber cement board. The panel can, however, also be made of other materials. The visible side 3 and the rear side 4 run parallel to one another. The distance between the visible side 3 and the rear side 4 defines the thickness of the panel 2. In this case, the visible side 3 is the front side, which is typically visible after the panel 2 has been mounted. The rear side 4 of the panel 2 is the side which is typically oriented against a substructure.

At least one slot 5 is worked into the panel 2 via the rear side 4 of the panel 2. The number of slots 5 depends substantially on the size of the panel. The number of slots 5 defines the number of fastening points of a panel 2. The larger the panel 2, the greater the number of slots 5 or fastening points. The slot 5, which is illustrated in detail in FIG. 2, extends along a longitudinal axis L. The slot 5 has a stop face 6. A first slot portion 7 of the slot 5 extends from the rear side 4 up to the stop face 6. A second slot portion 9 of the slot 5 extends from the stop face 6 up to the slot base 8. The width B7 of the first slot portion is smaller than the width of the second slot portion 9.

Figure 9:
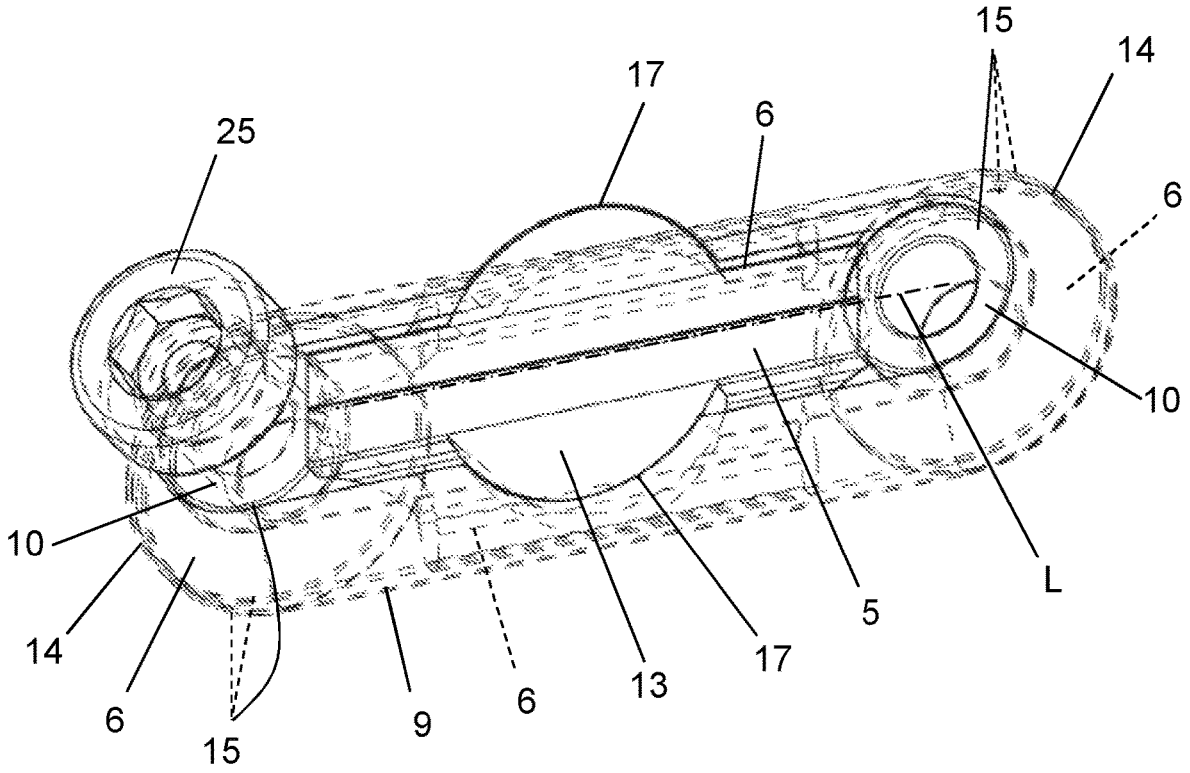
FIG. 9 shows a perspective view of the panel fastening system with other fastening elements.
Figure 10:
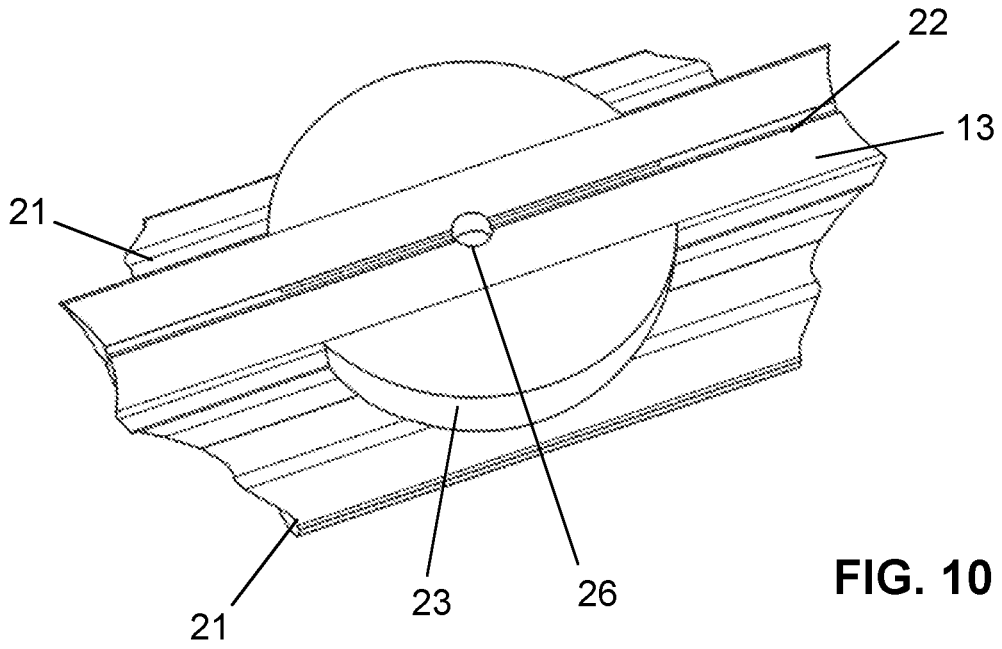
FIG. 10 shows a perspective view of a securing element according to a further embodiment.
Figure 11:
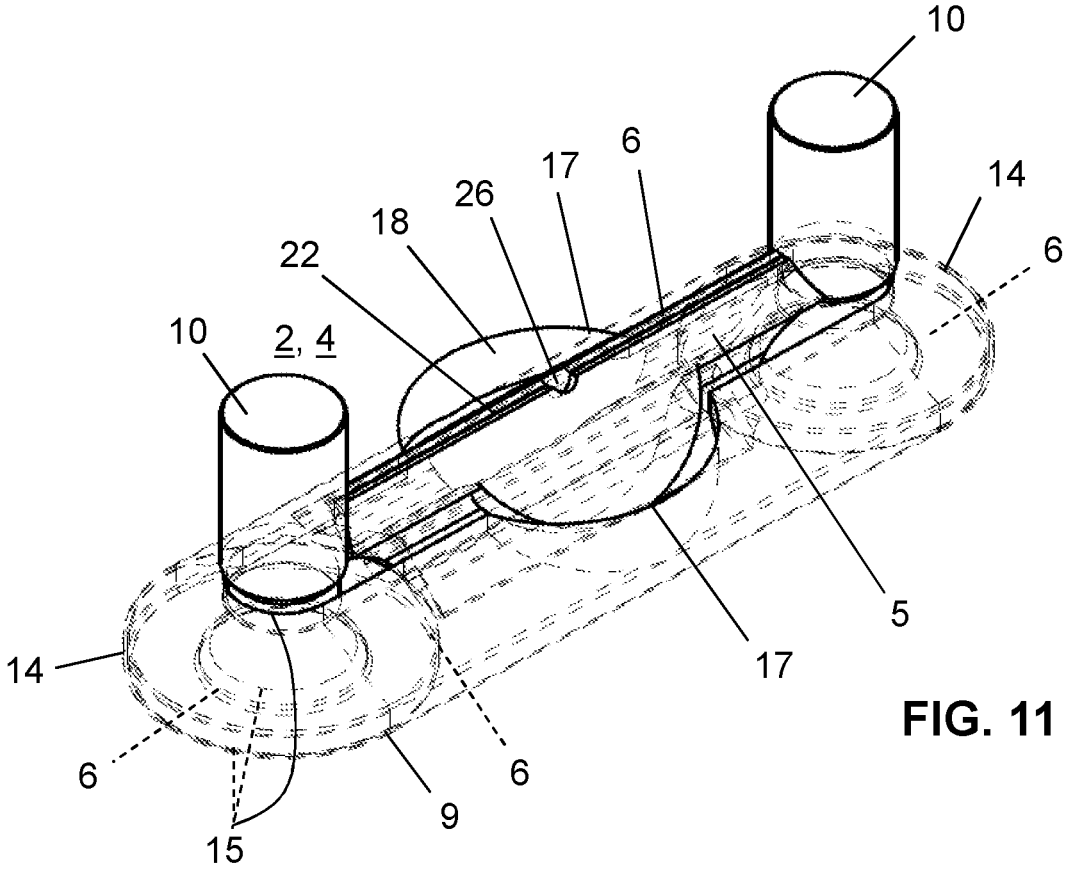
FIG. 11 shows a perspective view of the slot with fastening elements inserted and a partially inserted securing element as per FIG. 10.
Figure 12:
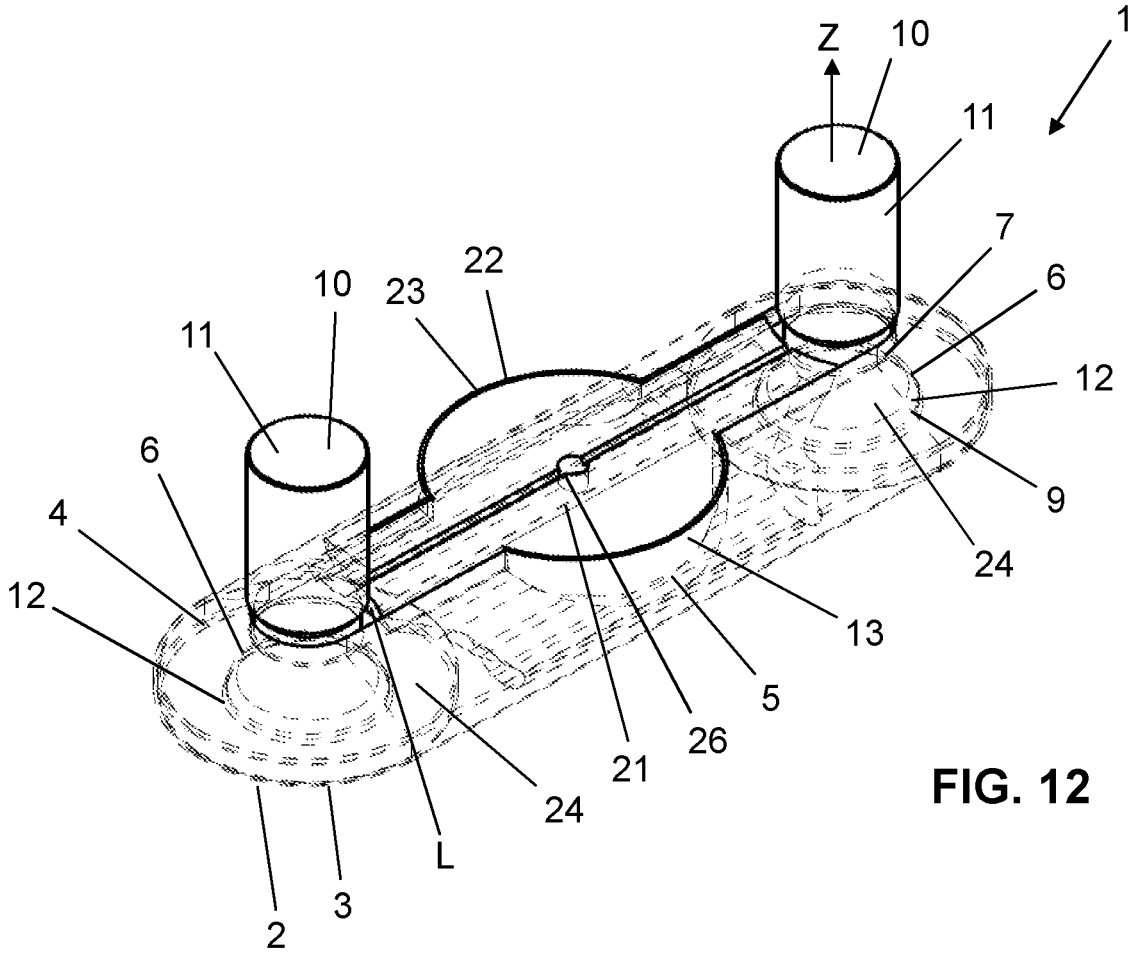
FIG. 12 shows the view as per FIG. 11 with a fully inserted securing element.
Figure 13:
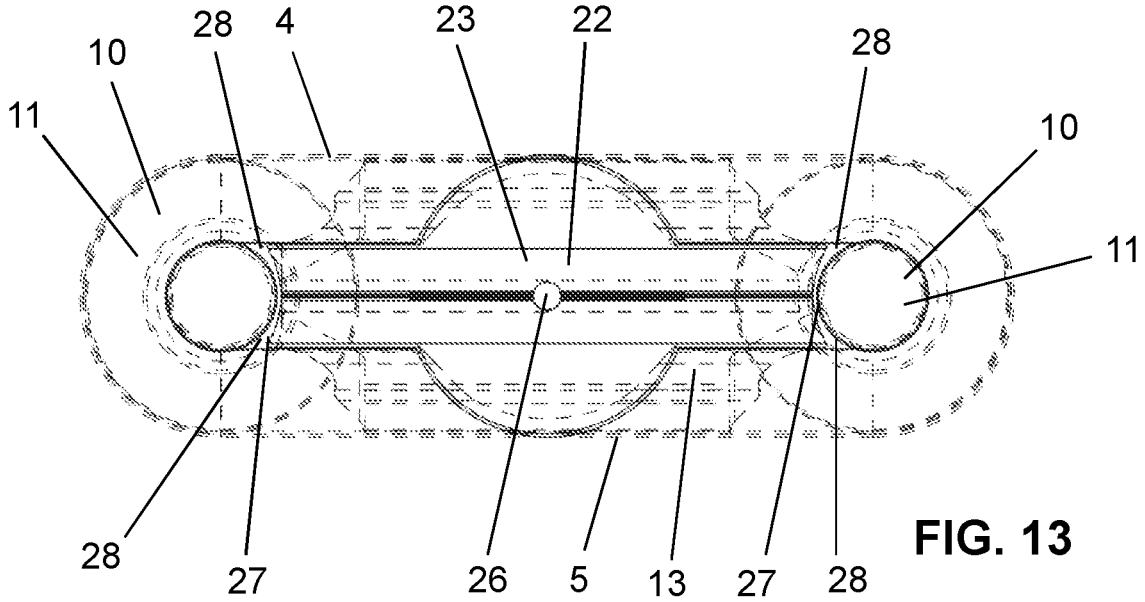
FIG. 13 shows a view as per FIG. 12 from above.

The panel fastening system 1 further comprises at least one fastening element 10 which is inserted into the slot 5. In the embodiments shown, in each case two fastening elements 10 are arranged per slot 5. The fastening element 10 comprises a fastening portion 11. The fastening portion 11 is designed here in FIGS. 1 to 8 as a threaded bolt, but can also have the shape of a threaded nut in other embodiments, as shown in FIG. 9. The fastening element 10 furthermore comprises a contact face by means of which the fastening element 10 abuts against said stop face 6 of the slot 5. Here, the stop face 6 is part of a flange 24 adjoining the fastening portion 11. The flange 24 has a greater diameter than the fastening portion 11, and lies here in the second slot portion 9.

The panel fastening system 1 also comprises at least one securing element 13, which securing element 13 can be arranged in the slot 5. A first embodiment of the securing element is shown in FIGS. 1 to 9, and a second embodiment of the securing element is shown in FIGS. 10 to 13. Identical features are denoted by identical reference designations and the description of the one embodiment is applicable to the description of the other embodiment. The securing element 13 secures the at least one fastening element 10 against a movement in the direction of the longitudinal axis L. The securing element 13 is used to fixedly retain the at least one fastening element in the slot 5 with respect to a movement in the direction of the longitudinal axis L.

With reference to FIGS. 2 to 5, an explanation will now be given as to how the fastening elements 10 and the securing element 13 are positioned in the slot 5 of the panel 2.

The slot 5, as described above, is illustrated in more detail in FIG. 2. Here, the slot 5 furthermore comprises a mounting opening 18. Here, the mounting opening 18 lies centrally between the two end regions 14 of the slot 5. The end regions 14 of the slot 5 have a rounded design and correspondingly terminate the slot 5 in terms of its longitudinal direction. The diameter D18 of the mounting opening 18 corresponds substantially to the width B9 of the second slot portion 9.

Figure 3:
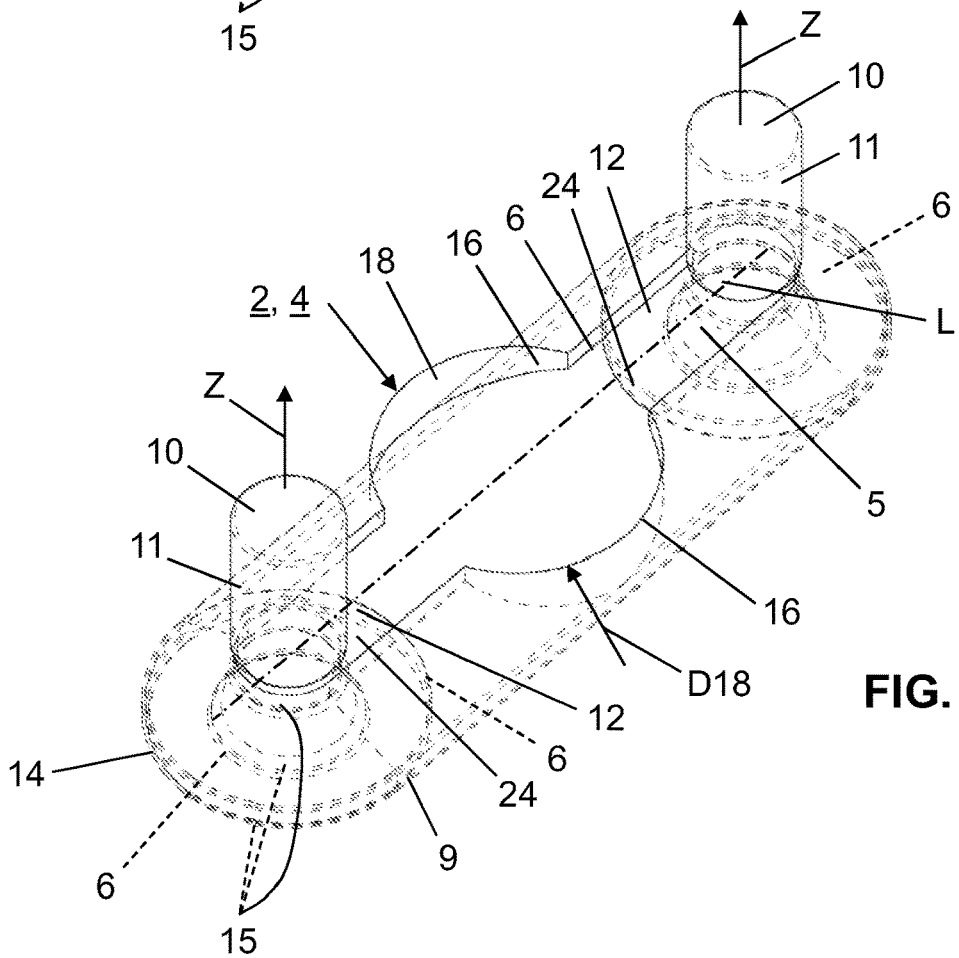
FIG. 3 shows a perspective view of the slot as per FIG. 1 with fastening elements inserted.

The fastening elements 10 are inserted individually into the slot 5 via the mounting opening 18 and can then be moved in the direction of the longitudinal axis L to the respective end region 14. In FIG. 3, the two fastening elements 10 lie in a respective end region 14 of the slot 5. Here, the fastening elements 10 are in a surface contact with the corresponding end regions 14.

As soon as the fastening elements 10 lie at the correct position, the securing element 13 can be inserted. The securing element 13 may be an insert part, as is illustrated in the figures and also explained below. As an alternative, however, the securing element 13 may also be a curable composition which is filled into the slot 5 and then cured there.

Figure 4:
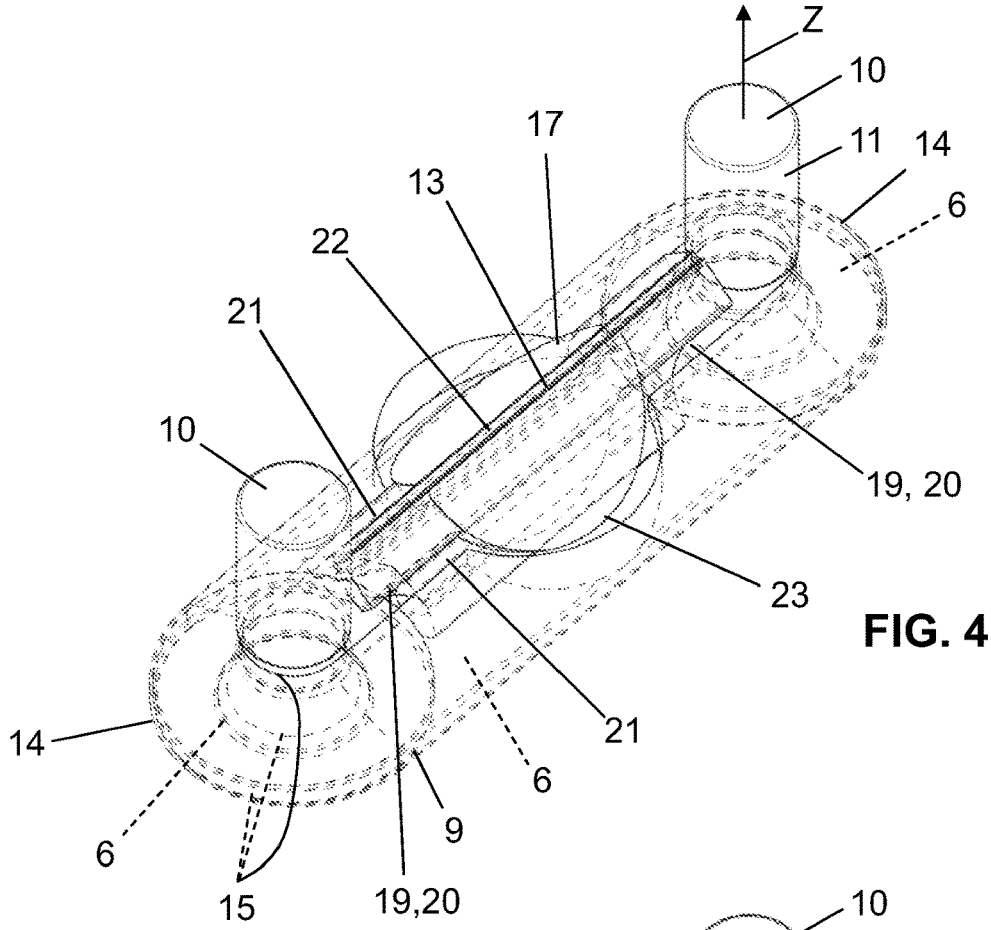
FIG. 4 shows a perspective view of the slot as per FIG. 1 with fastening elements inserted and a partially inserted securing element.

FIG. 4 shows the insertion of the insert part in more detail. In the embodiment shown, the insert part comprises two insert part portions 21, which are illustrated in the folded-together state in FIG. 4. In this folded-together state, the insert part can be inserted from above, that is to say from the rear side 4, into the slot 5. For this purpose, the insert part is guided through the first slot portion 7. The insert part portions 21 then come into contact with the slot base 8. As a result of further insertion of the insert part, the insert part portions 21 move into the second slot portion 9 under the stop face 6.

Figure 5:
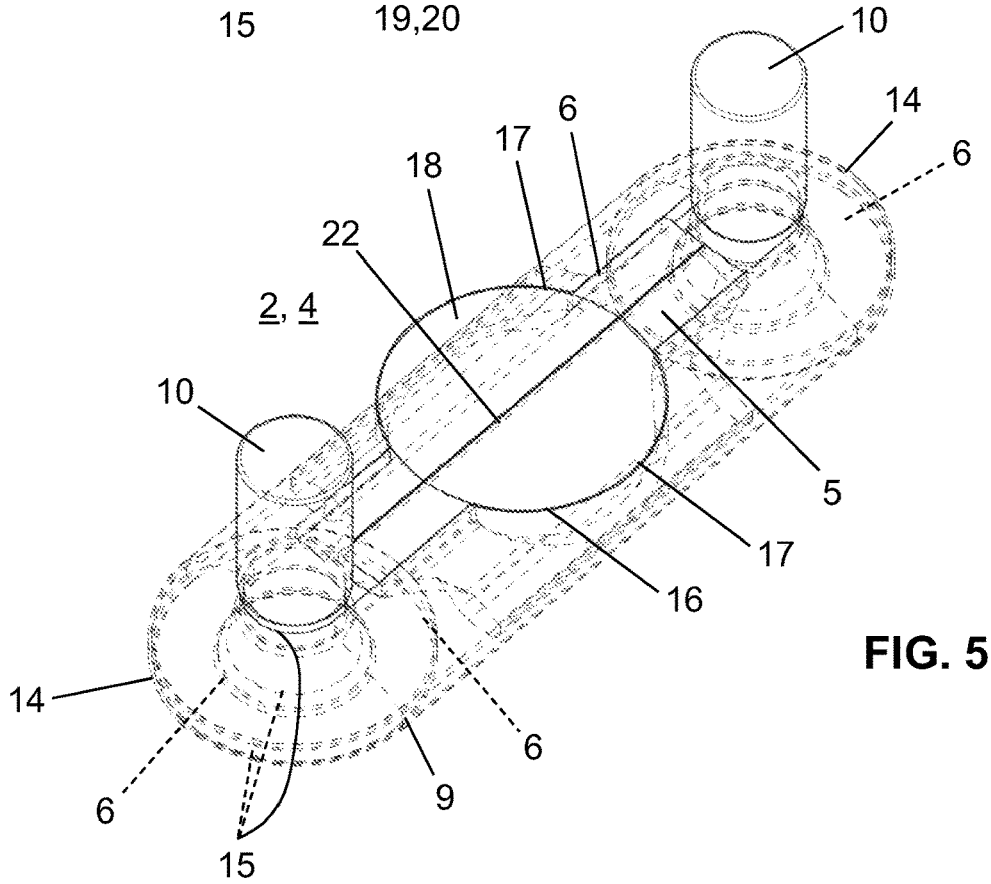
FIG. 5 shows a perspective view of the slot as per FIG. 1 with fastening elements inserted and a fully inserted securing element.

FIG. 5 shows that the securing element 13 designed as an insert part fills the entire interior space of the slot 5 between the two fastening elements 10, in such a way that the insert part prevents a movement of the fastening elements 10 toward one another along the longitudinal axis L. The securing element 13 therefore forms a stop against the displacement of the two fastening elements 10.

The securing element 13 preferably lies in the slot in such a way that said securing element does not extend beyond the rear side 4 out of the slot 5. This ensures that the securing element 13 does not adversely affect the mounting operation of the panel fastening system 1.

The stop face 6 in the slot 5 forms a stop against a pulling-out force Z, which acts on the fastening element 10 substantially at a right angle with respect to the rear side 4.

In the embodiment shown, the slot 5 has a further stop face 16. The further stop face 16 is provided here by the side wall of the mounting opening. The securing element 13 also has a face 17, wherein when the securing element 13 is inserted into the slot 5, the face 17 comes into contact with the further stop face 16 in such a way that the securing element 13 is prevented from moving in the direction of the longitudinal axis L. The contact between the further stop face 16 and the face 17 also affords the advantage that it is also possible for only one fastening element 10 to be inserted, wherein the securing element 13 has the same effect.

The arrangement of the fastening elements 10 in the end regions 14 of the slot 5 also affords the advantage that the actual area of overlap between the stop face 6 and the contact face 12 is increased. In the embodiment shown, the actual area of overlap of the stop face 6 and the contact face 12, as seen from above, is substantially ring-shaped, wherein the ring is interrupted by the slot 5, in particular the first slot portion 7.

Here, the end regions 14 have a rounded end faces 15, against which the fastening element 10 bears.

In the embodiment shown, the slot is essentially a dovetail slot, wherein the stop face 6 runs at an angle in an angularly inclined manner with respect to the rear side 4. The angle is between 15° and 75°. The angular arrangement of the stop face 6 affords the advantage that the pulling-out force Z is introduced into the panel 2 in a satisfactory manner.

Figure 6:
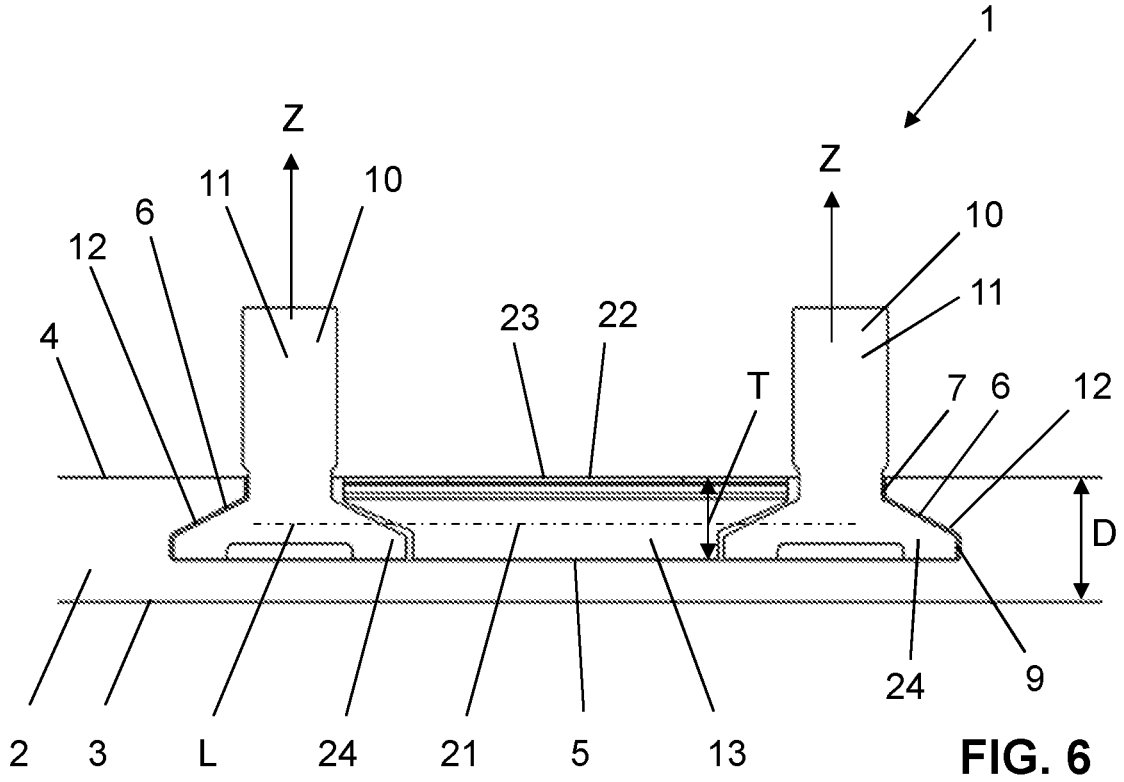
FIG. 6 shows a sectional illustration through the longitudinal axis of the slot as per the preceding figures.

FIG. 6 shows a cross section through the longitudinal axis L. The angular arrangement of the stop face 6 can be readily seen from the cross section of FIG. 6. The contact face 12 is likewise arranged in an angular manner, with the result that the stop face 6 and the contact face 12 are in areal contact with one another. The securing element 13 also has, in the region of its two end sides 19, a surface region 20 which can be connected to the at least one fastening element 10. The surface region 20 has a shaping which is designed to match the shape of the contact face 12.

FIG. 6 also shows that the securing element 13 is located completely in the interior space of the slot 5 and does not protrude beyond the rear side 4.

The thickness D of the panel 2 is also illustrated in FIG. 6. The slot has, as seen from the rear side 4 of the panel 2, a depth T which corresponds to not more than 50% of the thickness D of the panel 2.

A specific variant of the securing element in the form of the insert part is shown in more detail in FIGS. 7 and 8. As mentioned, the insert part has two insert portions 21 which are connected to one another by means of a film hinge 22, wherein the insert portions 21 can be pivoted about the film hinge 22 relative to one another. The film hinge 22 is provided by a thin wall between the two insert portions 21.

The insert portions are shown in the folded-together state in FIG. 7. In the folded-together state, the insert portions 21 lie against one another and the insert part can be inserted with the insert portions 21 first into the slot 5. During the insertion operation, the insert portions 21 can be brought into contact with the slot base 8 in such a way that, upon further insertion of the insert part into the slot, the insert portions 21 can be inserted into the region between the stop face 6 and the slot base 8. This is then the state illustrated in FIG. 8.

As mentioned, FIG. 9 shows the fastening element 10 in the form of a threaded nut, into which a screw 25 can be screwed. All the other elements are of identical design and reference is made to the above description.

The securing element 13 according to the second embodiment as per FIGS. 10 to 13 is inserted into the slot 5 in the same way as the securing element of the first embodiment as per FIGS. 1 to 9.

The securing element 13 as per FIGS. 10 to 13 furthermore has an opening 26. The opening 26 is arranged in such a way that the securing element 13 can be removed again using a hook-like tool. The opening 26 extends through the film hinge 22 in the embodiment shown.

Furthermore, the securing element 13 has a rounded portion 27 in the region of the fastening element 10. The rounded portion 27 affords the advantage that the contact area between the securing element 13 and the fastening element 10 can be optimized. The securing element 13 thus extends into the two gaps 28 between the outer diameter and the first slot portion 7.

Furthermore, the securing element 13 according to the second embodiment has, in the region of the insert portions 21, a shape which brings about a somewhat greater overlap of the flange 24.

LIST OF REFERENCE DESIGNATIONS

1 Panel fastening system
2 Panel
3 Visible side
4 Rear side
5 Slot
6 Stop face
7 First slot portion
8 Slot base
9 Second slot portion
10 Fastening element
11 Fastening portion
12 Contact face
13 Securing element
14 End region
15 End faces
16 Further stop face
17 Face
18 Mounting opening
19 End side
20 Surface region
21 Insert portion
22 Film hinge
23 Cylindrical portion
24 Flange
25 Screw
26 Opening
27 Rounded portion
28 Gap
L Longitudinal axis
B7 Width of the first slot portion
B9 Width of the second slot portion
D18 Diameter of the mounting opening
Z Pulling-out force

The invention claimed is:

1. A panel fastening system comprising:

a panel having a visible side and a rear side, at least one slot which is provided into the rear side of the panel and which extends along a longitudinal axis, and which has at least one stop face, wherein a first slot portion extends between the at least one stop face and the rear side, and wherein a second slot portion extends between the at least one stop face and a slot base, and at least one fastening element which is inserted into the slot and which has a fastening portion and a contact face, wherein the contact face of the fastening element abuts against the at least one stop face, wherein the panel fastening system further comprises at least one securing element which can be arranged in the slot, wherein the at least one securing element secures the at least one fastening element against a movement in the direction of the longitudinal axis when the securing element is arranged in the slot, wherein the slot has two spaced end regions and the at least one fastening element comprises two fastening elements, wherein one of said fastening elements is arranged in each of the two end regions, and wherein the securing element extends from one of the fastening elements to the other of the fastening elements; or wherein the slot has two spaced end regions, wherein the fastening element is arranged only in one of the two end regions, and wherein the securing element extends between the end regions from the fastening element to the other of the end regions.

2. The panel fastening system as claimed in claim 1, wherein the panel is a fiber cement board.

3. The panel fastening system as claimed in claim 1, wherein the slot has a further stop face, and wherein the securing element has a face, wherein when the securing element is inserted into the slot, the face comes into contact with the further stop face in such a way that the securing element is prevented from moving in the direction of the longitudinal axis.

4. The panel fastening system as claimed in claim 1, wherein the slot has a mounting opening via which the at least one fastening element can be inserted into the slot, wherein the diameter of the mounting opening, as seen transverse to the longitudinal axis, corresponds substantially to the width of the second slot portion.

5. The panel fastening system as claimed in claim 1, wherein the stop face of the slot runs parallel to the rear side, or wherein the stop face of the slot runs inclined at an angle with respect to the rear side.

6. The panel fastening system as claimed in claim 1, wherein the stop face of the slot extends on both sides with respect to the first slot portion.

7. The panel fastening system as claimed in claim 1, wherein the securing element is designed as at least one insert part.

8. The panel fastening system as claimed in claim 7, wherein the insert part has, at least on one end side, a surface region which can be placed against the at least one fastening element.

9. The panel fastening system as claimed in claim 7, wherein the insert part has two insert portions which are connected to one another by means of a film hinge, wherein the insert portions can be pivoted about the film hinge relative to one another, wherein the insert part can be inserted into the slot when the insert portions are in a folded-together state, and wherein, during the insertion operation, the insert portions can be brought into contact with the slot base in such a way that, upon further insertion of the insert part into the slot, the insert portions can be inserted into a region between the stop face and the slot base.

10. The panel fastening system as claimed in claim 7, wherein the insert part has, on a top side, a cylindrical portion which comes to lie in a mounting opening and/or wherein the securing element furthermore has an opening which is arranged in such a way that the securing element can be removed.

11. The panel fastening system as claimed in claim 1, wherein the securing element furthermore has an opening which is arranged in such a way that the securing element can be removed.

12. The panel fastening system as claimed in claim 1, wherein the securing element is a viscous composition which can be introduced into the slot and which can be cured in the slot.

13. The panel fastening system as claimed in claim 1, wherein the fastening portion has a female thread, wherein the nominal diameter of the female thread is smaller than the width of the first slot portion; or wherein the fastening portion has an external thread which extends out of the slot beyond the rear side.

14. The panel fastening system as claimed in claim 1, wherein the slot has, from the rear side as far as the slot base, a depth which is designed in such a way that a residual wall thickness of the panel remains in a region of the slot.

15. A method for providing a panel fastening system as claimed in claim 1, wherein in a first step, the at least one fastening element is inserted into the slot, and wherein, in a second step subsequent to the first step, the securing element is arranged in the slot.

16. A method for providing a panel fastening system which comprises a panel having a visible side and a rear side, at least one slot which is provided into the rear side of the panel and which extends along a longitudinal axis, and which has at least one stop face, wherein a first slot portion extends between the at least one stop face and the rear side, and wherein a second slot portion extends between the at least one stop face and a slot base, and at least one fastening element which is inserted into the slot and which has a fastening portion and a contact face, wherein the contact face of the fastening element abuts against the at least one stop face, wherein the panel fastening system further comprises at least one securing element which can be arranged in the slot, wherein the at least one securing element secures the at least one fastening element against a movement in the direction of the longitudinal axis, wherein in a first step, the at least one fastening element is inserted into the slot, and wherein, in a second step subsequent to the first step, the securing element is arranged in the slot.

17. A panel fastening system comprising:

a panel having a visible side and a rear side, at least one slot which is provided into the rear side of the panel and which extends along a longitudinal axis, and which has at least one stop face, wherein a first slot portion extends between the at least one stop face and the rear side, and wherein a second slot portion extends between the at least one stop face and a slot base, and at least one fastening element which is inserted into the slot and which has a fastening portion and a contact face, wherein the contact face of the fastening element abuts against the at least one stop face, wherein the panel fastening system further comprises at least one securing element which can be arranged in the slot, wherein the at least one securing element secures the at least one fastening element against a movement in the direction of the longitudinal axis when the securing element is arranged in the slot, and wherein the slot has a further stop face adjacent the at least one stop face, and wherein the securing element has a face, wherein when the securing element is inserted into the slot, the face comes into contact with the further stop face in such a way that the securing element is prevented from moving in the direction of the longitudinal axis.

18. The panel fastening system as claimed in claim 17, wherein the panel is a fiber cement board.

19. The panel fastening system as claimed in claim 17, wherein the slot has at least one end region, wherein one of said fastening elements is arranged in the end region, and wherein the securing element extends away from the fastening element in the direction of the longitudinal axis; or wherein the slot has two end regions, wherein one of said respective fastening element is arranged in each of the two end regions, and wherein the securing element extends from one of the fastening elements to the other of the fastening elements; or wherein the slot has two end regions, wherein the fastening element is arranged only in one of the two end regions, and wherein the securing element extends from the fastening element to an opposite end region.

20. The panel fastening system as claimed in claim 17, wherein the slot has a mounting opening via which the at least one fastening element can be inserted into the slot, wherein the diameter of the mounting opening, as seen transverse to the longitudinal axis, corresponds substantially to the width of the second slot portion.

21. The panel fastening system as claimed in claim 17, wherein the stop face of the slot runs parallel to the rear side, or wherein the stop face of the slot runs inclined at an angle with respect to the rear side.

22. The panel fastening system as claimed in claim 17, wherein the stop face of the slot extends on both sides with respect to the first slot portion.

23. The panel fastening system as claimed in claim 17, wherein the securing element is designed as at least one insert part.

24. The panel fastening system as claimed in claim 23, wherein the insert part has, at least on one end side, a surface region which can be placed against the at least one fastening element.

25. The panel fastening system as claimed in claim 23, wherein the insert part has two insert portions which are connected to one another by means of a film hinge, wherein the insert portions can be pivoted about the film hinge relative to one another, wherein the insert part can be inserted into the slot when the insert portions are in a folded-together state, and wherein, during the insertion operation, the insert portions can be brought into contact with the slot base in such a way that, upon further insertion of the insert part into the slot, the insert portions can be inserted into a region between the stop face and the slot base.

26. The panel fastening system as claimed in claim 23, wherein the insert part has, on a top side, a cylindrical portion which comes to lie in a mounting opening and/or wherein the securing element furthermore has an opening which is arranged in such a way that the securing element can be removed.

27. The panel fastening system as claimed in claim 17, wherein the securing element furthermore has an opening which is arranged in such a way that the securing element can be removed.

28. The panel fastening system as claimed in claim 17, wherein the securing element is a viscous composition which can be introduced into the slot and which can be cured in the slot.

29. The panel fastening system as claimed in claim 17, wherein the fastening portion has a female thread, wherein the nominal diameter of the female thread is smaller than the width of the first slot portion; or wherein the fastening portion has an external thread which extends out of the slot beyond the rear side.

30. The panel fastening system as claimed in claim 17, wherein the slot has, from the rear side as far as the slot base, a depth which is designed in such a way that a residual wall thickness of the panel remains in a region of the slot.

31. A method for providing a panel fastening system as claimed in claim 17, wherein in a first step, the at least one fastening element is inserted into the slot, and wherein, in a second step subsequent to the first step, the securing element is arranged in the slot.

32. A panel fastening system comprising:

a panel having a visible side and a rear side, at least one slot which is provided into the rear side of the panel and which extends along a longitudinal axis, and which has at least one stop face, wherein a first slot portion extends between the at least one stop face and the rear side, and wherein a second slot portion extends between the at least one stop face and a slot base, and at least one fastening element which is inserted into the slot and which has a fastening portion and a contact face, wherein the contact face of the fastening element abuts against the at least one stop face, wherein the panel fastening system further comprises at least one securing element which can be arranged in the slot, wherein the at least one securing element secures the at least one fastening element against a movement in the direction of the longitudinal axis when the securing element is arranged in the slot, wherein the slot has a mounting opening via which the at least one fastening element can be inserted into the slot, wherein the diameter of the mounting opening, as seen transverse to the longitudinal axis, corresponds substantially to the width of the second slot portion.

33. The panel fastening system as claimed in claim 32, wherein the panel is a fiber cement board.

34. The panel fastening system as claimed in claim 32, wherein the slot has at least one end region, wherein one of said fastening elements is arranged in the end region, and wherein the securing element extends away from the fastening element in the direction of the longitudinal axis; or wherein the slot has two end regions, wherein a respective fastening element is arranged in each of the two end regions, and wherein the securing element extends from one of the fastening elements to the other of the fastening elements; or wherein the slot has two end regions, wherein the fastening element is arranged only in one of the two end regions, and wherein the securing element extends from the fastening element to an opposite end region.

35. The panel fastening system as claimed in claim 32, wherein the slot has a further stop face, and wherein the securing element has a face, wherein when the securing element is inserted into the slot, the face comes into contact with the further stop face in such a way that the securing element is prevented from moving in the direction of the longitudinal axis.

36. The panel fastening system as claimed in claim 32, wherein the stop face of the slot runs parallel to the rear side, or wherein the stop face of the slot runs inclined at an angle with respect to the rear side.

37. The panel fastening system as claimed in claim 32, wherein the stop face of the slot extends on both sides with respect to the first slot portion.

38. The panel fastening system as claimed in claim 32, wherein the securing element is designed as at least one insert part.

39. The panel fastening system as claimed in claim 38, wherein the insert part has, at least on one end side, a surface region which can be placed against the at least one fastening element.

40. The panel fastening system as claimed in claim 38, wherein the insert part has two insert portions which are connected to one another by means of a film hinge, wherein the insert portions can be pivoted about the film hinge relative to one another, wherein the insert part can be inserted into the slot when the insert portions are in a folded-together state, and wherein, during the insertion operation, the insert portions can be brought into contact with the slot base in such a way that, upon further insertion of the insert part into the slot, the insert portions can be inserted into a region between the stop face and the slot base.

41. The panel fastening system as claimed in claim 38, wherein the insert part has, on a top side, a cylindrical portion which comes to lie in a mounting opening and/or wherein the securing element furthermore has an opening which is arranged in such a way that the securing element can be removed.

42. The panel fastening system as claimed in claim 32, wherein the securing element furthermore has an opening which is arranged in such a way that the securing element can be removed.

43. The panel fastening system as claimed in claim 32, wherein the securing element is a viscous composition which can be introduced into the slot and which can be cured in the slot.

44. The panel fastening system as claimed in claim 32, wherein the fastening portion has a female thread, wherein the nominal diameter of the female thread is smaller than the width of the first slot portion; or wherein the fastening portion has an external thread which extends out of the slot beyond the rear side.

45. The panel fastening system as claimed in claim 32, wherein the slot has, from the rear side as far as the slot base, a depth which is designed in such a way that a residual wall thickness of the panel remains in a region of the slot.

46. A method for providing a panel fastening system as claimed in claim 32, wherein in a first step, the at least one fastening element is inserted into the slot, and wherein, in a second step subsequent to the first step, the securing element is arranged in the slot.

47. A panel fastening system comprising:

a panel having a visible side and a rear side, at least one slot which is provided into the rear side of the panel and which extends along a longitudinal axis, and which has at least one stop face, wherein a first slot portion extends between the at least one stop face and the rear side, and wherein a second slot portion extends between the at least one stop face and a slot base, and at least one fastening element which is inserted into the slot and which has a fastening portion and a contact face, wherein the contact face of the fastening element abuts against the at least one stop face, wherein the panel fastening system further comprises at least one securing element which can be arranged in the slot, wherein the at least one securing element secures the at least one fastening element against a movement in the direction of the longitudinal axis when the securing element is arranged in the slot; and wherein the fastening portion has a female thread, wherein the nominal diameter of the female thread is smaller than a width of the first slot portion; or wherein the fastening portion has an external thread which extends out of the slot beyond the rear side.

48. The panel fastening system as claimed in claim 47, wherein the panel is a fiber cement board.

49. The panel fastening system as claimed in claim 47, wherein the slot has at least one end region, wherein one of said fastening elements is arranged in the end region, and wherein the securing element extends away from the fastening element in the direction of the longitudinal axis; or wherein the slot has two end regions, wherein a respective fastening element is arranged in each of the two end regions, and wherein the securing element extends from one of the fastening elements to the other of the fastening elements; or wherein the slot has two end regions, wherein the fastening element is arranged only in one of the two end regions, and wherein the securing element extends from the fastening element to an opposite end region.

50. The panel fastening system as claimed in claim 47, wherein the slot has a further stop face, and wherein the securing element has a face, wherein when the securing element is inserted into the slot, the face comes into contact with the further stop face in such a way that the securing element is prevented from moving in the direction of the longitudinal axis.

51. The panel fastening system as claimed in claim 47, wherein the slot has a mounting opening via which the at least one fastening element can be inserted into the slot, wherein the diameter of the mounting opening, as seen transverse to the longitudinal axis, corresponds substantially to the width of the second slot portion.

52. The panel fastening system as claimed in claim 47, wherein the stop face of the slot runs parallel to the rear side, or wherein the stop face of the slot runs inclined at an angle with respect to the rear side.

53. The panel fastening system as claimed in claim 47, wherein the stop face of the slot extends on both sides with respect to the first slot portion.

54. The panel fastening system as claimed in claim 47, wherein the securing element is designed as at least one insert part.

55. The panel fastening system as claimed in claim 54, wherein the insert part has, at least on one end side, a surface region which can be placed against the at least one fastening element.

56. The panel fastening system as claimed in claim 54, wherein the insert part has two insert portions which are connected to one another by means of a film hinge, wherein the insert portions can be pivoted about the film hinge relative to one another, wherein the insert part can be inserted into the slot when the insert portions are in a folded-together state, and wherein, during the insertion operation, the insert portions can be brought into contact with the slot base in such a way that, upon further insertion of the insert part into the slot, the insert portions can be inserted into a region between the stop face and the slot base.

57. The panel fastening system as claimed in claim 54, wherein the insert part has, on a top side, a cylindrical portion which comes to lie in a mounting opening and/or wherein the securing element furthermore has an opening which is arranged in such a way that the securing element can be removed.

58. The panel fastening system as claimed in claim 47, wherein the securing element furthermore has an opening which is arranged in such a way that the securing element can be removed.

59. The panel fastening system as claimed in claim 47, wherein the securing element is a viscous composition which can be introduced into the slot and which can be cured in the slot.

60. The panel fastening system as claimed in claim 47, wherein the slot has, from the rear side as far as the slot base, a depth which is designed in such a way that a residual wall thickness of the panel remains in a region of the slot.

61. A method for providing a panel fastening system as claimed in claim 41, wherein in a first step, the at least one fastening element is inserted into the slot, and wherein, in a second step subsequent to the first step, the securing element is arranged in the slot.

* * * * *